United States Patent [19]

Lagendijk

[11] 4,450,656

[45] May 29, 1984

[54] SUSPENDED ROOF

[76] Inventor: Johannes Lagendijk, Octant 197, Sterrenburg, 3328 SL Dordrecht, Netherlands

[21] Appl. No.: 330,515

[22] Filed: Dec. 14, 1981

[51] Int. Cl.[3] ..... E04B 1/12

[52] U.S. Cl. ..... 52/63; 52/83

[58] Field of Search ..... 52/83, 223 R, 63, 80, 52/81; 135/87, 101

[56] References Cited

U.S. PATENT DOCUMENTS

| | | | |
|---|---|---|---|
| 2,592,465 | 4/1952 | Pont | 52/80 |
| 2,677,384 | 5/1954 | Luisada . | |
| 2,693,195 | 11/1954 | Frieder et al. | 52/83 X |
| 2,880,741 | 4/1959 | McGrand | 135/87 X |
| 3,153,302 | 10/1964 | Wheeler . | |
| 3,465,764 | 9/1969 | Huddle . | |
| 3,914,077 | 10/1975 | Lodes . | |
| 3,950,901 | 4/1976 | Slumner . | |
| 4,367,761 | 1/1983 | Winant | 135/87 |

FOREIGN PATENT DOCUMENTS 7018039 6/1971 Netherlands .

OTHER PUBLICATIONS

DBZ Deutsche Baul Eitschrift-Bertelsmann Fachrerlag-Guetersloh-Joargang 10, No. 5, May 1962.

Otto FBEI: "Raumtragwerke, Ver Suchbauten", pp. 725-728.

*Primary Examiner*—Carl D. Friedman

*Attorney, Agent, or Firm*—Young & Thompson

[57] ABSTRACT

A suspended roof is described, which mainly consists of a cable rope structure (20-27; 31-33, 35-37; 39, 40) coverable with a stiff weatherproof material. By the special way according to which the cables are led, passing over fixed mountings (8, 9, 10, 11) and/or other points-of-change-of-direction (8, 9, 10, 11; 28, 30, 37, 38), equalizing the tension in different cable parts (20, 21; etc.), together with the use of a minimum of stiff compression members (31; 43; 47) to form stiff girders after having tensioned the cable ropes to the design tension, a suspended roof is obtainable which is as stiff as a conventional stiff-girder-roof-structure. As a result a classic stiff roof covering may be applied to it. The ground plan coverable may have any shape, and need not be symmetrical.

The described roof structure is stiff in contrast to the generally adopted tent-type suspended roof structure built from cable rope which is basically flexible.

10 Claims, 6 Drawing Figures

SUSPENDED ROOF

The invention relates to a suspended roof supported by at least three fixed mountings of which the supporting roof structure mainly consists of a cable construction to which a weatherproof roof covering is applicable, adapted for rainwater drainage to the sides, with diagonal main tension cables led from the fixed mountings which meet in the centre of the roof, forming roof ridges and with side top cables, the roof valleys running into the side top cables between each pair of fixed mountings.

Suspended roof constructions have been known in various forms. The Dutch Patent Application No. 7018039 describes a construction which is intended for large spans. For that purpose a number of points in the roof plane is lifted by means of doubled cables with spacers placed in between, but nowhere are there continuous stiff through-girders formed which cover the complete span. Neither in the centre nor at the points of support bending moments can be transmitted. As a result, it is out of the question to build a roof, by means of the said construction, which considerably deviates from the known tent-roof type constructions. According to the publication, the local stiffenings form a member of roof tops, with roof valleys in between, which is useful for the rainwater drainage and can locally increase the stiffness. Nevertheless the whole design will retain the character of a non-stiff tent roof.

The invention using as few compression members as possible and a maximum of flexible cables, to the contrary also aims at providing a suspended roof construction of such rigidity that the roof covering can also be of a stiff nature, to the extent of the use of concrete.

By applying known stiff roof covering materials, not only the insulation, particularly thermal insulation, can be fitted easily and well, but also the stability of such a roof against external loads, and in particular against wind load, is with stiff roofs many times better than with flexible roofs of the tent type. The latter usually behave badly under windloads. The advantages gained over the classical stiff roof constructions built on stiff girders are among other things, the relatively simple construction, lower cost price, lower structural weight and the simple foundations usually required.

The invention aims at providing a suspended roof combining the advantages of a cable structure with those of a conventional stiff roof.

The suspended roof as described in the preamble is characterized according to the invention in that each side top cable has been fixed with its one end to one of the fixed mountings and, after having been led round over the adjacent fixed mounting, continues as a diagonal main tension cable to the centre of the roof, in that the other end of this cable has been connected in the centre to the ends of the other diagonal main tension cables, and in that each side top cable between each pair of fixed mountings is mainly tensioned vertically downwards by means of a post-tensioning cable, all this in such a way that the centre of the roof is lifted to form the roof top, which top reaches a higher level than the side top cables on the spot where they meet with the roof valleys.

According to the invention each side top cable, after having been led round one of its fixed mountings, continues as a diagonal main tension cable to the centre of the roof. By tensioning the parts of this cable the same tension is introduced in the side top cable as in the diagonal main tension cable. This tensioning is introduced by means of a post-tensioning cable which extends approximately vertically, pulling down the side top cable between its two points of support in an approximately vertical direction. This will normally be carried out at the centre of the side top cable, but this is not strictly necessary. Tensioning in this way has a twofold result: the centre of the roof where all diagonal main tension cables meet and have been connected to one another is in this way raised to a level which approximates to that of the fixed mountings. If, moreover, the diagonal main tension cables are stiffened to become girders, the roof centre will be able to form an apex, which can even have a higher level than that of the fixed mountings. Another result of applying said post-tensioning cables is the fact that starting from the apex to the downwardly tensioned point of application of the post-tensioning cable to the side top cable, a roof valley is created in contrast to the diagonal main tension cables which form the roof ridges.

Thus in an alternating way the roof structure is shaped by the diagonal main tension cables which form the roof ridges, and the roof valleys which run from the apex to the downwardly tensioned connection point in each side top cable. If a roof covering is fitted to this roof structure its dead load and its life load due to wind, snow, thermal influences, etcetera, tend to force the side top cable out of the desired plane. In order to prevent this, the invention according to a preferential form of executing, is characterized in that against each side top cable at the point of connection to the post-tensioning cable at least one compression member has been placed with its one end mainley perpendicular to the cable, and the other end of this member being connected by means of cables to the same fixed mountings, between which the side top cable has been tensioned, and in that the other end of each compression member is connected by means of a cross tie cable to the apex or through the apex to the other end of one of the other compression members, all this in such a way that the side top cable is stiffened to remain in the desired side plane under load as well. In this way a first girder is created by means of tying cables and a compression member. It will be clear that in spanning a large surface, various other cables and members have to form the roof structure apart from the said cables, in order to be able to support the roof covering ultimately in a sufficiently stiff way. These additional cables and members are functionally to be compared with the aforementioned diagonal cables, cross tie cables and compression members. In the same way as described for the side top cable, it is possible in the plane of the roof structure and also perpendicularly to it and at different angles, to transform the cables and compression members into stiff girders. Although the said roof structure is ultimately stiff, in order to be able to adopt a stiff roof construction, also a flexible roof of the tent-type can be fitted to it. It will be clear that the said cross tie cables, extending in the compression members ending in the lowest points of the side top cables, are constituting together the aforementioned roof valleys.

As far as the roof, according to the invention, has a symmetrical ground plan with regard to the fixed mountings, the tensions in all the side top cables and in all diagonal main tension cables in case cf a symmetrical load on the roof, are about the same. In case of an asymmetrical ground plan of the roof, this may only partly be the case. One of the principal advantages of the roof according to the invention is that it can cover almost any given ground plan. This is of course also due for the fixed mountings. The rainwater collected by the roof is drained off in a natural way through the roof valleys to the sides of the roof, from where, if desired, it may be drained off by means of rain pipes.

A particular characteristic of the roof, according to the invention, consists of the fact that during the construction and the erection the cables and compression members which have previously been made to the desired length, can be assembled practically without pretensioning and consequently without difficulty. Only after all cables and compression members have been placed and have been brought to the right length by means of tensioners, the whole roof structure is post-tensioned by pulling the vertical post-tensioning cables downwards over the pre-calculated distance.

The compression members mentioned before, will, with a view to the roof load, be mainly directed vertically, while compression members which have been fitted for the sake of windbracing and for other considerations with respect to the stability, can run in various directions, such as in horizontal planes. If certain sections of main or cross tie cables are comparatively long, they can be stiffened into girders in the known way by using more than one compression member and cross tie cables.

Because a great freedom is created by the invented roof structure, truss cables situated under the proper roof plane can e.g. be designed in a horizontal plane but also under certain angles, in order to form fastening elements under the suspended roof for e.g. lighting ornaments, hoisting equipment and other indoor provisions.

According to the invention the roof is also characterized in that the cables and/or compression members of the roof structure which define the upper side of the roof plane have mainly been embedded within the roof covering. By this it is achieved that the maintenance of these roof structure elements can be reduced to a minimum and that the roof covering insulates these elements against vibrations and temperature influences. Wear by relative movements over the cables is also prevented in this way.

Further the roof consists of at least one upper supporting coarse mesh net and at some distance under it, a fine mesh net, the lower net being tightly anchored to the moderately tensioned roof structure. This net or both nets, together with the post-tensioning of the roof structure, have been tensioned up to the final design tension, before at least a first layer of the roof covering is applied. As it appears from the above, first the roof structure consisting of the cables and the compression members is fitted to the fixed mountings, and pretensioned to such a degree that the desired geometry is nearly reached. Next the nets are fitted and anchored to the cables, after which the whole, including the nets, is post-tensioned up to the design tension by means of the downwardly directed post-tensioning cables.

During the post-tensioning the above mentioned roof valleys are formed in the roof plane and the apex(es) and the ridges will reach the design level.

Due to the above procedure it is possible to load the pretensioned roof structure already lightly, for instance with workers who lay and anchor the nets. After post-tensioning of the structure and the nets, a stiffness is obtained which is comparable with that of the classical girders constructed with stiff bars and strutts.

According to a further preferred embodiment, the suspended roof consists of a lower fine mesh net and of a coarse mesh net which has been placed at a predetermined distance above the lower, the roof covering being poured or sprayed on the fine mesh net in a first layer of such a thickness that on it, after hardening, if necessary, the coarse mesh net can be fitted for reinforcement. To this the second layer is applied, the coarse mesh net becoming embedded. If said net is sufficiently coarse, the first layer can eventually be applied through it. The coarseness or fineness of the nets is not only determined by considerations as to the strength, but also by considerations in connection with the viscosity of the roof covering material to be applied and the time required for hardening. Good moistening qualities are of importance as well. The nettings can to this effect be composed of glassfibre mats and the roof material of sprayed polyurethene foam, to which for the sake of weather resistance a layer of bituminous roofing felt or the like has been bonded. The roof structure which is already stiff of its own is, after hardening of the roof covering as far as stiffness and strength are concerned, completely comparable with a conventional stiff roof. An extra-ordinary advantage of the roof covering as described consists of the very simple and cheap way of its applying. After hardening the roofers will already be able to walk on the first layer, thus finishing the roof from the inside to the outside. The applied foams are of an organic nature. If, however, inorganic materials are required, the invention provides for it, in that the nettings consist of glassfibre mats and in that the roof covering material consists of stiff elements of e.g. foamglass, which elements are bondened to the glass mats and to each other. Thus a completely weather-resistant stiff roof, which can be walked on, is obtained with a comparatively high insulating capacity. In this case the elements are fitted on top of the supporting net and consequently all roof-structural elements fall inside the space protected by the roof. For protection mainly against windload, a second net, e.g. made of glassfibre mats, may be fitted on top of the stiff roof covering elements.

The suspended roof according to the invention has at least three fixed mountings, one or more of these may be positioned above the natural ground level on a yoke or column which are kept in position by pretensioned yoke or column cables, which run to other fixed foundations. The fixed mountings can, however, also be fitted to e.g. a concrete wall, such as e.g. applied with tanks or warehouses. A suspended roof according to the invention covering them, may be of great value, thanks to its good insulating properties.

A further important advantage of the roof construction according to the invention is its safety against overload. Where a conventional stiff roof with classical stiff girders would collapse completely in case of overload, the invented suspended roof may be provided at the fixed mounting with means which in case of overload, give a predetermined relaxation of the cable tensions by being flexible over a predetermined distance. It is true that due to this, fractures or cracks could occur in the stiff roof covering, but a complete collapse is prevented. In many cases it will be possible to repair the fractures or cracks after a re-tensioning procedure of the cables to the usual design tension. A great advantage of this is also the fact that in many cases lower safety coefficients may be applied when designing the roof. Considerable economical advantages may be involved.

Finally the fastening of one or more of the cables to the ends of the compression members can, according to a preferred embodiment, be achieved in a very simple manner, in case the compression member consists of a pipe with a square or round cross section, a bolt being lead right through the member near its end, and one or more cables have been laid parallel to the shank of the bolt against it in the longitudinal plane of the member and in case a cable clamp tightly pulls the cables and the bolt together, all this in such a way that the cables have been fixed mutually and with respect to the compression member.

As advantages over conventional stiff roofs with stiff girders, there can be mentioned:

drainage of rainwater always to the sides of the building as a result of the post-tensioning procedure, many cables can e.g. be led round the fixed mountings and round other mutual meeting points, due to which the number of cables is reduced, the tensions in the various parts of the cables will be equal, and there can be economized on tensioning means, that nets first serve as a formwork for applying the roof material and next as its reinforcements, that the number of members under compression is small and their length relatively short, that the roof structure, as the case occurs, can be erected and completed over an already existing building because the number of necessary columns or fixed mountings is very small, and much smaller than in case of conventional roofs, after which the old existing building can be pulled down in dry, that including the concrete foundations of the fixed mountings and the anchoring blocks for the post-tensioning, columns, if any, the roof structure, the nets and the roof covering, including the wages will amount to 50% less than the cheapest equivalent conventionally insulated roof and even up to 20% cheaper than a conventional non-insulated roof.

that the roof according to the invention, also when applying a utilitarian additional load does not need any supporting columns situated within the base area and that finally the construction offers an extremely great freedom of design, due to which the building can follow practically without restriction almost any form of the site available and consequently the available base area can be fully used, and provides the architect with an unknown freedom of design.

Finally it can be pointed out that due to the method of building it is possible to apply, starting from the fixed mountings, a temporary higher auxiliary roof, under which the permanent suspended roof according to the invention can be erected in dry. The use of many applicable roof covering materials requires a processing in dry and in some cases also above certain minimum temperatures. With a view to this the roof is particularly suited for so-called weather-unaffected projects. The applied auxiliary roof could principally consist of the same constructive lay-out as the definite roof, although in a simpler form, such as e.g. without insulation.

Further it is remarked that the thermal expansion of the various materials that have been used, is not different from that of conventional roofs and can in general without difficulties be taken up by the elasticity of the roof covering materials that have been used or by the filling materials of the seams. Temporary thermal and permanent displacements of the fixed mountings can in this way also be taken up well.

On the basis of the accompanying figures a preferred embodiment of the roof according to the invention will be further explained.

Figure 1:
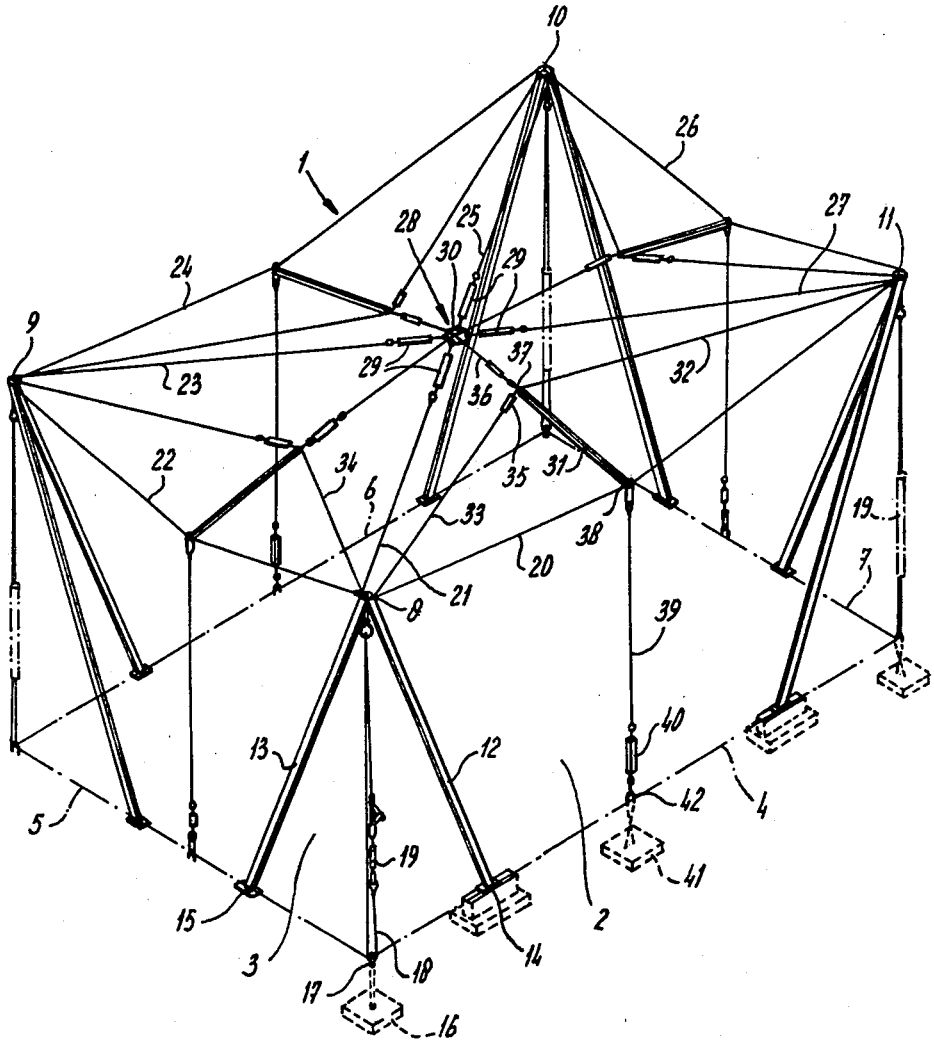
FIG. 1 shows schematically a building with a roof structure according to the invention.

In FIG. 1 a skeleton has been reproduced of a rectangular building with a roof in its entirety indicated by 1, the structure of which conforms to the invention. The building has two long and two short sides indicated by 2 respectively 3. The base area is bounded by the sides 4 up to 7. Vertically above the four angular points are the so called fixed mountings 8 up to 11. These are formed by the meeting point of the corner columns, of which one has been indicated as the fixed mounting 8, but of which the others are similar fixed mountings. The two corner columns 12 and 13 are situated in the plane of the side walls 2 and 3 and have their foundation on the natural ground level in foundation blocks 14 and 15. In the four angular points are, below the natural ground level pretensioning or guyblocks 16, and from these blocks mooring eyes 17 extend up to the ground level. To these eyes 17 are fitted pretensioning or guy cables 18 with tensioning devices 19 incorporated in it, while the upper end has been attached to the corresponding fixed mounting 8.

It is pointed out that the fixed mountings 8 up to 11 can also be made in another way. As an example it can be stated that the fixed mountings could e.g. be situated in walls or concrete sides, which of course answer to the requirements as to strength which are dictated by the roof as described hereafter.

The roof structure consists in principle of four side top cables 20, 22, 24, 26, the one end of the side top cable 20 being firmly fixed to point 11, the cable being led around the fixed mounting 8 in a diagonal direction, acting as diagonal main tension cable 21 to the centre 28 of the roof. In a similar way the side top cable 22 is integral after rounding the fixed mounting 9 with the diagonal main tension cable 23. All diagonal cables have tensioning devices 29 and have been attached with each other by a ring 30 on the spot of centre 28. As it will turn out further on, the diagonal main tension cables 21, 23, 25, 27 form ultimately the roof ridges of the roof. Each side top cable 20 forms together with its compression member 31 which has been fitted in its centre, and the inner bracing cables 32 and 33, a stiff girder, namely the roofline side top girder. The side top cable 22 has been integrated into a stiff girder in a similar way, the inner bracing cable 34 forming one of the elements. The inner bracing cables 33 and 34 form one cable length which is led round in the fixed mounting 8, so that one tensioner 35 will suffice. The other inner bracing cables have been constructed in a similar way.

In order to keep the side top cable 20 in the plane of the side wall 2 cross tie cables 36 have been fitted between the inner end 37 of compression member 31 and the central ring 30. In FIG. 1 a construction is depicted in which the cross tie cable 36 has been connected with the corresponding cross tie cable of side top cable 24. The same holds for the cross tie cables between the side top cables 22 and 26 at the short sides of the building. Here the required tensioning devices have been fitted as well.

To point 38, where compression member 31 has been attached to the centre of side top cable 20, also a post-tensioning cable 39 has been attached which runs vertically downwards and which has been attached to eye 42 by means of a tensioner 40 near the ground level. The eye 42 has been firmly fixed to a post-tensioning ballast block 41 which lies below the ground level. In a similar way the post-tensioning cables run in the plane of the other side walls vertically downwards from the centre of the side top cables 22, 24 and 26. The post-tensioning cable 39, however, can also be retensioned via other cable combinations, mainly in vertical direction.

By what has been mentioned above the structure of the suspended roof according to the invention has been principally described. In the erection of the roof the post-tensioning cables 39 are at first unloaded and all the cables in the roof plane are lightly pretensioned by means of the pretensioning or guy cables 18 so that they with good approximation have the required position. Then by tensioning the post-tensioning cables 39, all the cables of the roof structure are tensioned up to the design or service tension. In doing so the centre 38 of the side top cable moves vertically downwards so that the compression member 31 with in its continuation the cross tie cable 36 takes the shape of a roof valley whereas the diagonal main tensioning cables 21, 23, 25 and 27 will form roof ridges. Thus a stiff roof construction with drainage from the roof centre to the centres of the four side top cables has been created. By the formation of girders such as 20, 31, 32 and 33 the roof has been stiffened in the horizontal plane.

Figure 2:
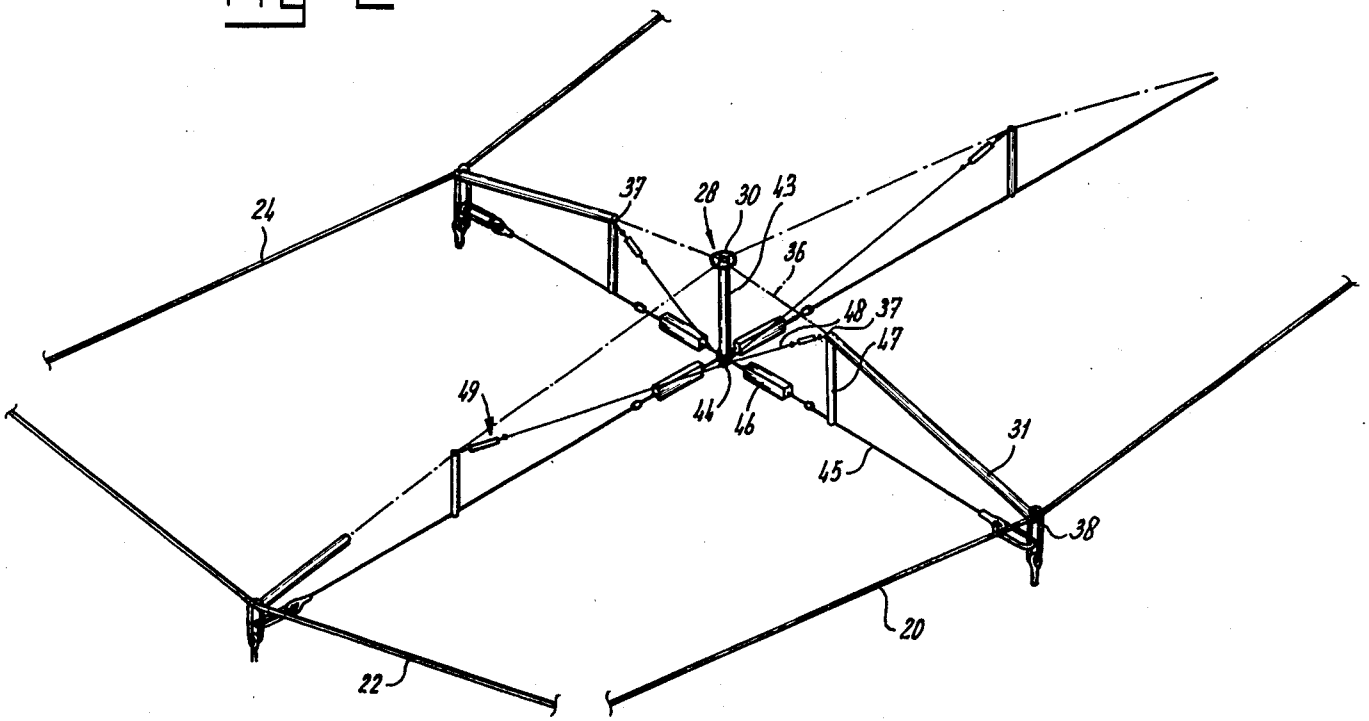
FIG. 2 shows schematically two girders at the roof valleys of the suspended roof according to FIG. 1.

FIG. 2 shows schematically the stiffening into a girder in the vertical plane of the compression members 31 with in its continuation the cross tie cable 36 and thus also the creation of the apex 28 with apex ring 30. For reasons of simplification the apex ring 30 has been drawn in FIG. 2 as a point. FIG. 2 serves to be considered as an addition to the roof structure according to FIG. 1. In a similar way other cables in the roof and, if appropriate, in the side walls of the building, could be stiffened into girders, if circumstances would require. This can take place both in the plane and perpendicular to the plane of the roof or the wall.

For this reason a short vertical compression member 43 has been placed in the apex 28–30, to the lower end 44 of which a lower running cable 45 has been fitted which runs to point 38 in the centre of the corresponding side top cable 20. In the lower running cable 45 a tensioning device 46 has been installed. In a similar way a lower bracing cable has been tensioned to the side top cable 24, resulting in a stiff girder formed in the vertical plane.

Since in many cases the dimensions are such that the described stiffening is insufficient, the girder can be further subdivided by fitting a next vertical compression member 47 which is coupled to point 37 and is fastened to cable 45. A diagonal cable 48 with tensioning device completes this subdivision by connecting point 37 with point 44. In a similar way the other roof structure cables are stiffened into girders as has been indicated schematically at 49.

Attention is drawn to the fact that by means of the lower running cables 45 the level of the apex 28–30 can be varied with respect to the fixed mountings 8 up to 11. Due to this on the one hand the angle of inclination of the various roof planes can be chosen as desired, but on the other hand the lower running cables 45, which are inside the building under the roof, can also be brought into the desired plane. In particular it is possible to bring all the lower running cables 45 into the same horizontal plane. Moreover, the lower running cables 45 make it also possible to be used as supports for illumination fittings and the like. From an analysis of the roof structure as depicted in the FIGS. 1 and 2 it appears that with a minimum of pressure-loaded compression members, a stiff roof is created by exclusively using cables for all other elements.

Figure 3:
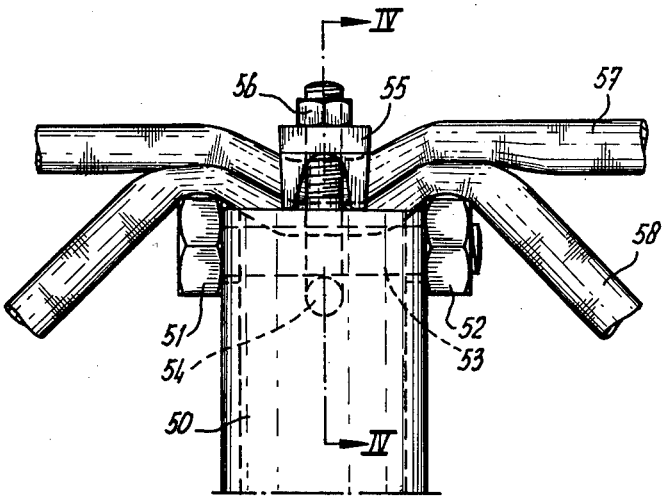
FIGS. 3 and 4 show two mutually perpendicular sections of the cable mountings to a compression member, as applicable to the suspended roof according to the invention.
Figure 4:
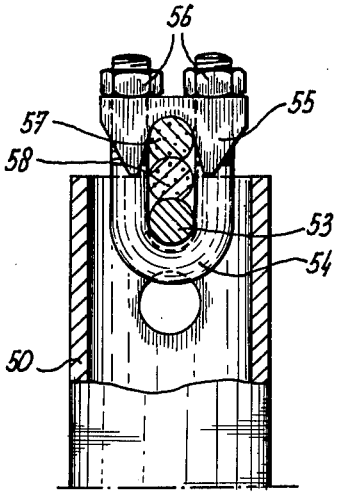

In the FIGS. 3 and 4 has, by way of exemple, been depicted a possible fastening device between the end of a compression member and a number of cables which pass approximately perpendicularly to the member. In this case such a connection can consist of one compression member with one cable but also of one compression member with various cables, in which case these cables need not run in the same plane with the compression member.

An advantage of the hereunder described connection consists of the fact that the system is very simple, universal, that is to say, suited for the fastening of more than one cable to one end of the compression member, while during the erection phase of the building structure and the roof the connection still enables relative movements between the cables mutually and with respect to the compression member, before the connection finally is tightened. Both FIGS. 3 and 4 show partly sectional views and partly side views of such a connection, FIG. 4 representing a perpendicular section according to the line 4—4 of FIG. 3. Although according to the invention various cables continue past a point a change of direction such as e.g. the ridge or one of the fixed mountings, and during the erection of the building or the roof must be able to slide mutually in said point, as is represented by the FIGS. 3 and 4, there are, however, also other connecting points where one of the cables ends. Although this has not been depicted, known cable constructions are applicable in this case, such as e.g. fitting a cable eye to the depicted cable clamp. Since an arbitrary compression member has been depicted in FIGS. 3 and 4, this has also got an arbitrary reference 50. Near its one end extends, via two holes, a pen in the form of a bolt 50 with nut 51, right through the compression member. Thus the shank of the bolt 53 follows a diametrical line in case the cross section of the member is circular, but square or rectangular sections are also possible. Round the centre of the shank 53 a U-shaped cable clamp 54 is fitted, on the two free ends of which thread has been cut. Over this falls the well-known gripping jaw 55 which can be forced further over the U-shaped cable clamp by means of two nuts 56. In this case the cables and the shank 53 are pulled against each other between the jaw and the body of the U-shape. As an example two passing cables with reference numerals 57 and 58 have been depicted. Where the cables traverse the end of the compression member it is advisable to prevent sharp kinks in the cable and other damages, by means known to the expert, e.g. by breaking sharp edges or by protecting the cable with a cover.

The FIGS. 3 and 4 only give examples of the very simple way in which the whole cable system can be fitted mutually and to the compression members and also between compression members mutually, in such a way that it still is possible during the erection and the pretensioning to shift them slightly and that after this they can be secured definitely.

As regards the protection against overload, if any, the fixed mounting can be fitted with means which in case of overload give a predetermined relaxation of the cable tension by being flexible over a predetermined distance.

In FIG. 1 this can easily be made clear because in the pretensioning cables 18 a breaking link for the relaxation can be fitted (only indicated in FIG. 1) which collapses above a predetermined maximum working load. Parallel to this breaking link, however, two other links have been inserted in the system which after giving way over a predetermined distance—to the length of some centimeters—depending on the size of the building, becomes tightened to take up the remaining load. Due to this the building structure as such is slightly deformed, but the complete cable structure remains unimpaired, is highly relieved and prevents the complete collapse of the building. Also the very elastic nets that have been inserted in the roof can, in general, handle these deformations without being damaged. Only in the actual stiff roof coverings fractures can occur. The roof, however, remains in principle stiff and stable. After the cable structure has again be brought to the design tension, the fractures that have occurred in the stiff roof can in many cases easily be repaired.

In the stage of pretensioning, the nets are tightly fitted to the cables and to the compression members. To this effect a number of fitting methods are known to experts both by means of clamping strips, individual clamps or also by means of bonded doublings. Stiff roof elements can be attached to the nets with known adhesives and moreover be secured by means of metal or other clamps. After completion the roof can be walked upon for inspection and maintenance.

Figure 5:
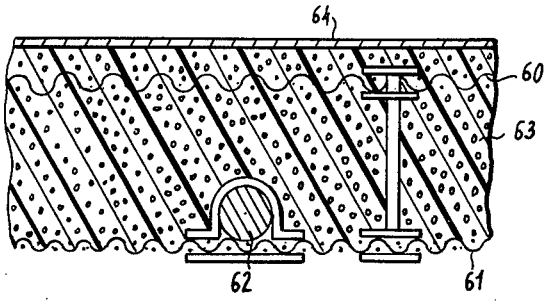
FIGS. 5 and 6 are fragmentary cross-sectional views of two different embodiments of the roof covering.

Specifically, as shown in a first embodiment in FIG. 5, the roof comprises an upper supporting coarse mesh net 60 and a fine mesh net 61 which is disposed at a predetermined distance therebelow. At least net 61 is tightly anchored to the moderately pretensioned roof structure 62. At least one of the nets has been tensioned up to the final design tension together with the post-tensioning of the roof structure, before the roof covering 63 is applied. Nets 60 and 61 are glass-fibre mats. The material of covering 63 is spray-applied polyurethane foam. On the upper side, an attached layer of bituminous roof felt 64 completes the roof.

Figure 6:
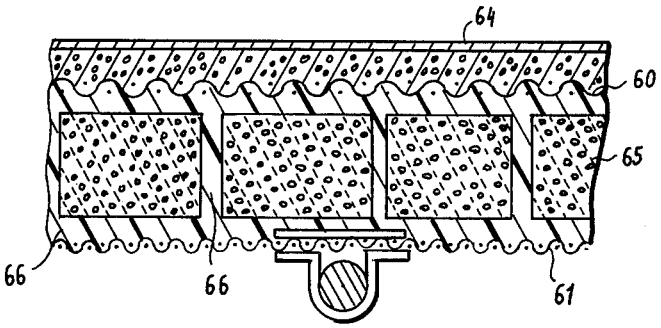

In FIG. 6, a second embodiment is shown, in which the coarse and fine mesh nets 60 and 61 are also present, as is the bituminous roof felt 64. But in place of the polyurethane foam 63 between the nets 60 and 61, there is applied a series of stiff elements of foam glass 65 which are secured to the glass-fibre mats and to each other by adhesive 66.

I claim:

1. Suspended roof, supported by at least three fixed mountings, of which the supporting roof structure mainly consists of a cable rope construction to which a weather-proof roof covering is applicable, adapted for rainwater drainage to the sides, with diagonal main tension cables led from the fixed mountings which meet in the centre of the roof and which form the roof ridges, and with side top cables, the roof valleys running into the side top cables between each pair of fixed mountings, characterized in that each side top cable (20, 22, 24, 26) has been fixed with its one end to one of the fixed mountings (11, 8, 9, 10) and after having been led round the adjacent fixed mounting (8, 9, 10, 11), continues as a diagonal main tension cable (21, 23, 25, 27) to the centre (28) of the roof, in that the other end of this cable has been connected in the centre (28) to the ends of the other diagonal main tension cables and in that each side top cable is mainly tensioned vertically downwards between each pair of fixed mountings by means of a post-tensioning cable, all this in such a way that the centre of the roof is lifted to form the roof apex (28), this apex being raised to a higher level than the side top cables on the point where they meet the roof valleys (38).

2. Suspended roof according to claim 1, characterized in that against each side top cable (20) on the point of connection (38) with the post-tensioning cable (39) at least one compression member (31) has been with its one end placed mainly perpendicularly on the cable (20), the other end of this member (31) being connected by means of cables (32, 33) to the same fixed mountings (8, 11) between which the side top cable has been tensioned, and in that the other end (37) of each compression member (31) has been connected by means of a cross tie cable (36) to the apex (28) or through the apex to the other end of one of the other compression members, all this in such a way that the side top cable is stiffened to remain in the desired side plane under load as well.

3. Suspended roof according to claim 1, in which the cables forming part of the roof structure have been stiffened into girders by means of compression members and bracing cables, characterized in that the cables and/or compression members of the roof structure which define the upper side of the roof plane have mainly been embedded within the roof covering.

4. Suspended roof according to claim 1, characterized in that the roof consists at least of an upper supporting coarse mesh net and of a fine mesh net which has been placed at a predetermined distance below, and in that at least the lower fine mesh net has been tightly anchored to the moderately pretensioned roof structure and in that at least one said net is tensioned up to the final design tension together with the post-tensioning of the roof structure, before at least an initial layer of the roof-covering is applied.

5. Suspended roof according to claim 4, characterized in that the roof consists of an upper supporting coarse mesh net and of a fine mesh net at a predetermined distance below, the roof covering material being applied to the fine mesh net in one or more layers of such a thickness that, after hardening, the coarse mesh net has been completely embedded to act as reinforcement as well.

6. Suspended roof according to claim 4, characterized in that the nettings consist of glass-fibre mats and in that the roof material consists of spray-applied polyurethene foam, with on the upper side an attached layer of bituminous roof felt or the like.

7. Suspended roof according to claim 4, characterized in that the nettings consist of glass-fibre mats and that the roof material consists of stiff elements of foam glass, which have been fixed to the glass mats and to each other.

8. Suspended roof according to claim 1, characterized in that one or more of the fixed mountings have been fitted above the natural ground level on a yoke or column, which is kept in position by pretensioned yoke or column cables running to other fixed foundations.

9. Suspended roof according to claim 1, characterized in that the fixed mounting has been fitted with means which in case of overload give a predetermined relaxation of the cable tensions by being flexible over a predetermined distance.

10. Suspended roof according to claim 1, one or more of the cables being fastened to the end of a compression member, characterized in that the compression member consists of a pipe with a square or round cross section, a bolt being led right through the member near its end, in that one or more cables have in the longitudinal plane of the member been laid parallel to the shank of the bolt against it and in that by means of a cable clamp the cables and the bolt have been tightly pulled together, all this in such a way that the cables have been fixed mutually and with respect to the compression member.

* * * * *